United States Patent [19]

Johannson

[11] Patent Number: 4,497,607

[45] Date of Patent: Feb. 5, 1985

[54] FORK POSITION RETAINER

[75] Inventor: Richard J. Johannson, Dallas, Oreg.

[73] Assignee: Towmotor Corporation, Mentor, Ohio

[21] Appl. No.: 386,829

[22] PCT Filed: Apr. 22, 1982

[86] PCT No.: PCT/US82/00519

§ 371 Date: Apr. 22, 1982

§ 102(e) Date: Apr. 22, 1982

[51] Int. Cl.[3] ..... B66F 9/14

[52] U.S. Cl. ..... 414/664; 403/83; 403/110; 414/667

[58] Field of Search ..... 414/663, 664, 667, 668, 414/671, 672, 785; 187/9 R; 403/83, 84, 88, 403/103, 104, 109, 110

[56] References Cited

U.S. PATENT DOCUMENTS

| | | | |
|---|---|---|---|
| 1,397,453 | 11/1921 | Rekar | 403/104 X |
| 3,851,779 | 12/1974 | Crawford . | |
| 4,002,256 | 1/1977 | Kroboth . | |
| 4,113,128 | 9/1978 | Foss . | |
| 4,221,535 | 9/1980 | Quinn | 414/785 |

FOREIGN PATENT DOCUMENTS

| | | | |
|---|---|---|---|
| 33246 | 3/1977 | Japan | 414/667 |
| 2017046 | 10/1979 | United Kingdom . | |
| 2040261 | 8/1980 | United Kingdom | 414/667 |

*Primary Examiner*—Robert G. Sheridan

*Attorney, Agent, or Firm*—Phillips, Moore, Lempio & Finley

[57] ABSTRACT

A lift truck carriage (12) is provided with a cylindrical bar (34) upon which the forks (16,18) may be mounted. The forks (16,18) are each retained in any desired position along the bar (34) by a clamp (42) located between a pair of mounting sleeves (28,30), and may be rotated about the axis of the bar (34) into a stowed position without having to unlock the clamping member (40).

9 Claims, 3 Drawing Figures

FIGURE 2
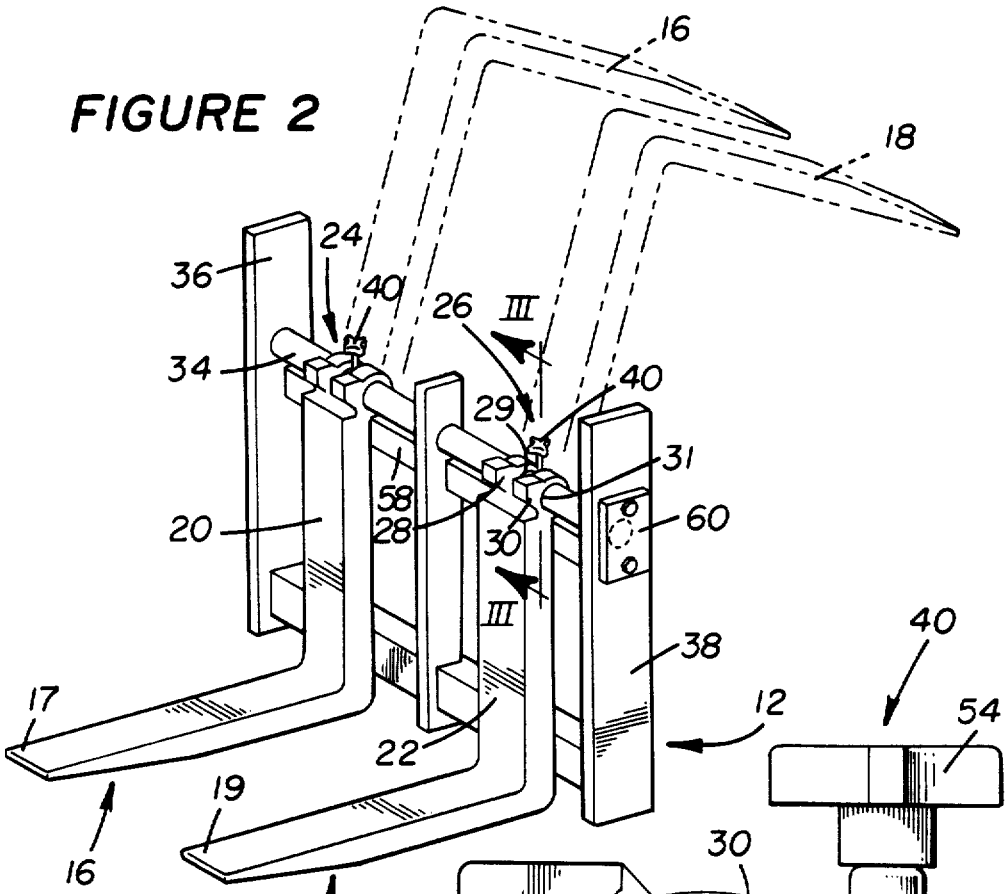
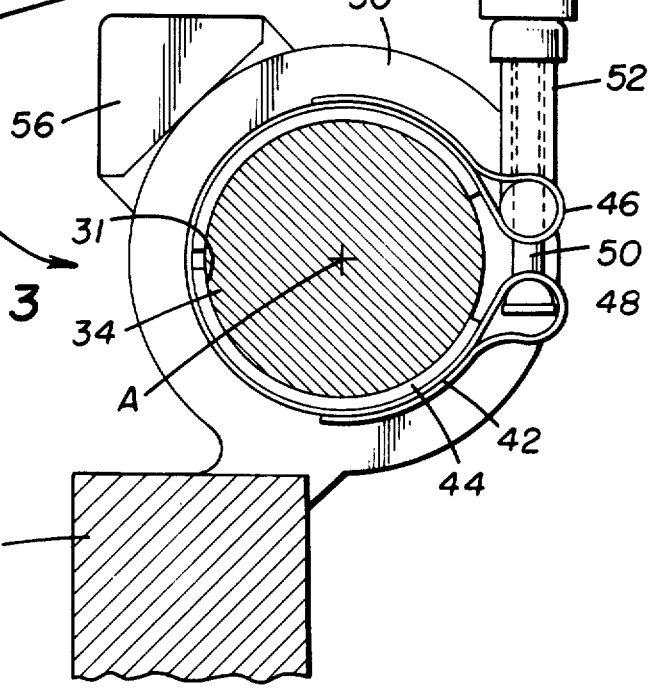
FIGURE 3

FORK POSITION RETAINER

TECHNICAL FIELD

This invention relates to a load handling vehicle, and in particular relates to the positioning of load handling forks on the movable carriage of a forklift.

BACKGROUND ART

In the load handling art, particularly in regard to vehicles which transport loads a short distance for positioning at various heights, there are numerous schemes to pick up and deposit the load. Most common among these schemes is the forklift vehicle. The forklift vehicle, as is well known, consists of a vehicle having a mast at one end upon which a carriage is mounted for vertical movement. A load handling device is fixed to the carriage so that the vehicle may be positioned adjacent a load to pick up and transport the load from one position to another. Most widely used with this type of vehicle for load handling are a pair of forks which are affixed to the carriage and extend outwardly in front of the vehicle. The forks serve to pick up a container or some other load for movement.

It is quite often necessary to adjust the spread between the two forks on the carriage in order to accommodate the vehicle to various types of loads. Further, should the vehicle need to be transported from one site to another, it is appropriate to either remove the forks or to rotate the forks rearwardly so that the overall length of the vehicle is shortened.

In order to accomplish variable separation of the forks, it has been common to mount the forks on the lift vehicle carriage in a manner that allows for a finite number of positions of the forks. This has been accomplished, for example, by a series of notches along the top of a bar or plate that forms a portion of the carriage. The forks are laterally slidable along the bar and have fitted at the upper end of the fork a pin or the like which engages a notch on the bar at the selected position of the fork. Generally, one type of arrangement has a hooked upper end on the fork to fit over the carriage plate or bar, thereby preventing rotation of the forks.

A second common method for mounting forks on the carriage of a lift truck uses a bar having a finite number of openings in the bar so that a U-shaped locking member may be dropped through the holes to retain the fork in one of a finite number of positions.

Forks have also been mounted on cylindrical bars so that the fork may be rotated about the bar into a retracted position alongside the vehicle. Generally, in this type of installation it is usually necessary to remove the locking pins to permit rotation of the fork.

The problem associated with all of the prior art installations are that the forks are limited to a finite number of positions along the mounting member because of the necessity to position a pin in either a notch or a hole to retain the fork. Further, the forks may be precluded from rotation to a stowed position by the nature of the mounting member, or may require removal of the locking pin to permit rotation.

DISCLOSURE OF THE INVENTION

The present invention is directed to overcoming one or more of the problems set forth above. In one aspect of this invention, a carriage and fork assembly for a load handling vehicle includes a carriage adapted for mounting on the load handling vehicle. The carriage includes a mounting shaft so that a fork having a load handling end and a mounting end may be fixed thereupon. Also included in the carriage and fork assembly is means for fixedly mounting the mounting end of the fork on the mounting shaft at any position therealong.

This structure overcomes the problems of earlier forklift mountings in that the forks are adjustable to an infinite number of positions along the carriage of the lift truck vehicle. Further, the structure disclosed herein facilitates the stowing of the forks alongside the vehicle for transport. The particular clamping structure allows the forks to be rotated about the mounting shaft without loosening the clamps.

BRIEF DESCRIPTION OF THE DRAWINGS

FIG. 2 is a more detailed view of the embodiment shown in FIG. 1 of the carriage assembly of the forklift.

FIG. 3 is a partial sectional view of the mounting shaft in fork as shown in FIG. 2.

BEST MODE OF CARRYING OUT THE INVENTION

Figure 1:
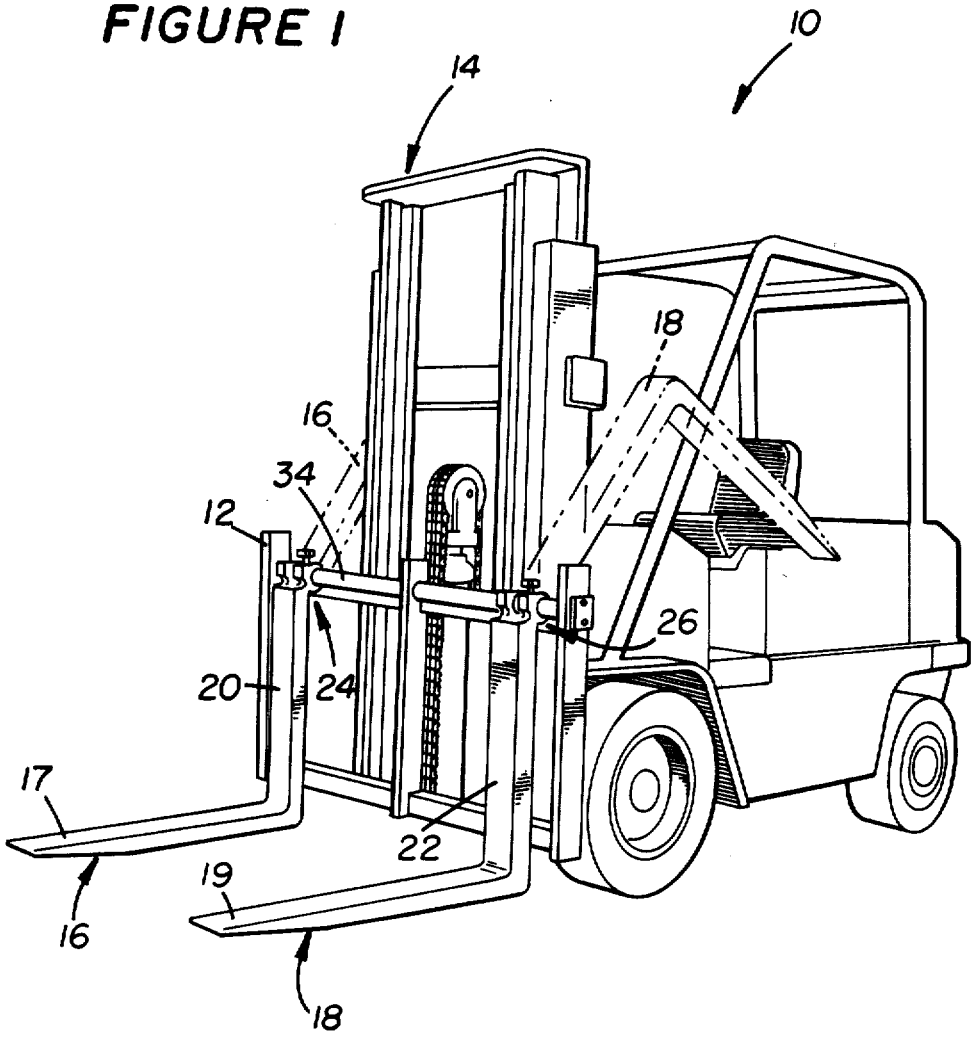
FIG. 1 shows in perspective a forklift having forks mounted thereupon forming an embodiment of the present invention.

Referring now to FIG. 1, a lift truck 10 is depicted with a carriage 12 movably mounted on a mast structure 14 in a conventional manner. Fixed to carriage 12 are a pair of load handling forks 16 and 18. Forks 16 and 18 are conventional in their general structure, each having an outwardly extending member 17 and 19, respectively, upon which a load may be carried. Each of the forks has an upstanding member 20 and 22, respectively, formed at right angles to the load handling portion of the forks and having a mounting end 24 and 26 at their upper ends. Mounting ends 24 and 26 are bifurcated, as can be seen in FIG. 2, and are formed with a hole or bore 29 and 31 therethrough on each portion of the bifurcations, as can be seen in FIG. 3 when taken in conjunction with FIG. 2.

It will be appreciated that the forks 16 and 18 are identical, thus only the fork 18 will be discussed in detail.

Referring now specifically to fork 18 and mounting end 26, the bifurcations 28 and 30 of fork 18, in this embodiment, are formed by two adjacent sleeves each having a cylindrical bore therethrough. The extensions of the axes A of these bores are substantially coincident so that fork 18 may be received on a mounting shaft 34, which is fixed between the end members 36 and 38 of carriage 12. Reference to FIG. 2 will show that the forks 16 and 18 thus mounted are free to move laterally along mounting shaft 34 to any of an infinite number of positions. Furthermore, each of the forks 16 and 18 is rotatable about mounting shaft 34 to a position as shown in phantom in FIG. 2. Referring now to FIG. 1, it can be seen that in load handling vehicle 10, with the forks in this position, the vehicle may be moved from one working site to another with the forks in a stowed position.

Mounted on shaft 34 between each bifurcation of each of the forks 16 and 18 is a clamping member 40 best seen in FIG. 3. Clamping member 40 serves to inhibit lateral movement of forks 16 and 18 along mounting shaft 34, but will not prohibit rotation of the forks to the stowed position as shown in phantom in FIGS. 1 and 2.

Clamping member 40 consists of a band 42 wrapped around a substantial portion of mounting shaft 32. Disposed between band 42 and mounting shaft 34 may be an anti-friction material 44 to provide a better gripping surface. The ends of band 42 are formed into loops 46 and 48, which are drawn together by a threaded member 50 acting in conjunction with a threaded sleeve 52. As can be seen in FIG. 3, threaded member 50 is associated with loop 48, while threaded sleeve 52 is associated with loop 46. Means for rotating threaded member 50, such as a cruciform-shaped handle 54 are provided. It should be understood that cruciform-shaped handle 54 may be removable so as not to interfere with rotation of forks 16 and 18 to their stowed position as shown in FIG. 2, or the handle can be sufficiently small to permit rotation without removal. Some other type of handle such as a bar may replace cruciform-shaped handle 54.

Mounting end 26 has fixed to sleeve portion 28 and 30 a stop member 56 which contacts a bar 58 fixed to carriage 12 behind and somewhat below mounting shaft 34. Stop member 56 permits rotation of the forks 16 and 18 to a point somewhat less than 200° from the position shown in FIG. 2.

Should it become necessary to remove the forks 16 and 18, a plate 60 may be removed from end member 38 so that mounting shaft 34 may be withdrawn from the carriage 12. It should be understood that clamping members 40 must, of course, be released before withdrawal of shaft 34 can take place.

While the preferred embodiment utilizes a cylindrical mounting shaft 34 to permit rotation of the forks, it should be appreciated that the infinite of the forks can be accomplished by a non-cylindrical mounting shaft if stowage of the forks for transit is not desired.

Industrial Applicability

Referring now to FIG. 1, it can be appreciated that the aforedescribed retention system is particularly applicable to use in a load handling vehicle such as a forklift 10. During operation, the forks 16 and 18 are positioned and clamped by clamping member 40 in the desired position for the particular type of load to be lifted. Should it be necessary to shift to a different type of load, this is easily accomplished by loosening each clamping member 40 and moving the forks 16 and 18 laterally along mounting shaft 34 to the desired position. Further, because the infinite positioning capability, the forks may be positioned asymmetrically with greater facility than with the more conventional pin and notch arrangements.

With the use of a clamping member 40 rather than pins and holes, as have been used in the past, it is possible to position and lock the fork members in a particular location anywhere along the mounting shaft 34. Fixing the forks in this manner is particularly important in a rough terrain type of load handling vehicle because of the varying size and positions of the loads to be handled.

Should it become necessary to move the vehicle from one working site to another, the forks merely have to be rotated as shown in FIG. 1 to their stowed position. It should be noted that rotation of the forks need not affect the permanent position of the forks since clamps 40 need not be loosened to rotate the forks.

Other aspects, objects, and advantages of this invention can be obtained from a study of the drawings, the disclosure, and the appended claims.

I claim:

1. A carriage and fork assembly for a load handling vehicle (10) comprising a carriage (12) mounted on said load handling vehicle (10), said carriage (12) having a mounting shaft (34);

a fork (18) having a load handling end (21) and a mounting end (26);

means (28, 30, 40) for selectively fixing the linear position of said mounting end (26) of said fork (18) at any position along said shaft (34) permitting rotation of said fork (18) about said shaft at said selected position and preventing linear movement of said fork at any rotated position.

2. The carriage and fork assembly of claim 1 wherein said mounting means (28,30,40) includes a bifurcated member, each branch (28,30) having a hole (29,31) therethrough, said holes (29,31) having a common axis (A) passing then through said holes (29,31) formed to receive said mounting shaft (34).

3. The carriage and fork assembly of claim 2 wherein said mounting shaft (34) has a circular cross section and said holes (28,30) have a circular cross section.

4. The carriage and fork assembly of claim 2 wherein the means (28,30,40) for fixedly mounting the fork on the mounting shaft includes a clamp (40) slidably mounted on said mounting shaft (34) between said bifurcations (28,30).

5. The carriage and fork assembly of claim 1 wherein the means for fixedly mounting the fork on the mounting shaft includes a pair of spatially separated sleeves (28,30) fixed to the mounting end (26) of said fork, each sleeve (28,30) defining an axis (A), the axes of said sleeves having extensions that are substantially coincident and said sleeves (28,30) slidably mountable on said mounting shaft;

and a clamp (40) mounted between said sleeves (28,30) on the mounting shaft and adapted to be clamped at any position along said mounting shaft (34).

6. The carriage and fork assembly of claim 5 wherein said mounting shaft (34) is of circular cross-section and said sleeves (28,30) are slidably mountable thereupon.

7. The carriage and fork assembly of claim 6 wherein the fork (18) is rotatable about the axis of the mounting shaft (34).

8. In a forklift vehicle (10) having a mast (14), a carriage (12) movably mountable on said mast (14), said carriage (12) having at least one load handling fork (18), the improvement comprising:

a round elongated mounting shaft (34) removably mounted on said carriage;

a pair of spatially separated sleeves (28,30), each being affixed to said fork (18) at end portion (26) thereof and being slidably rotatably mounted on said mounting shaft (34); and a clamp member (40) positioned on said mounting shaft between said sleeves (28,30), said clamp member being clampingly engagable with said mounting shaft (34) and contactable with said sleeve to inhibit sliding motion of said fork (18) along said mounting shaft (34), and said clamp member (40) permitting rotating motion of said fork (18) about said mounting shaft (34).

9. In a load handling device having a moveable carriage (12), the improvement comprising a cylindrical member (34) removably horizontally mountable in the carriage;

a load handling fork (18) slideably and rotatably mounted on the cylindrical member (34);

clamp means (40) for inhibiting sliding movement of said fork (18) at any position along said cylindrical member while permitting rotational motion of said fork (18) about and relative to said cylindrical member (34) and preventing linear movement of said fork at any rotated position.

* * * * *

Disclaimer and Dedication 4,497,607.—*Richard J. Johannson,* Dallas, Ore. FORK POSITION RETAINER. Patent dated Feb. 5, 1985. Disclaimer and Dedication filed Jan. 6, 1986, by the assignee, *Towmotor Corp.*

Hereby disclaims claims 1–9 and dedicates to the public the entire term of said patent.

[*Official Gazette April 8, 1986.*]